US007699620B2

(12) United States Patent
Lin et al.

(10) Patent No.: US 7,699,620 B2
(45) Date of Patent: Apr. 20, 2010

(54) ELECTRICAL CONNECTOR ASSEMBLY AND CLIP MECHANISM THEREOF

(75) Inventors: Nan-Hung Lin, Tu-cheng (TW); Fu-Pin Hsieh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/313,256

(22) Filed: Nov. 17, 2008

(65) Prior Publication Data

US 2009/0130899 A1 May 21, 2009

(30) Foreign Application Priority Data

Nov. 16, 2007 (CN) ..... 2007 2 0042303 U

(51) Int. Cl.
*H01R 12/00* (2006.01)

(52) U.S. Cl. ..... 439/73; 439/330

(58) Field of Classification Search ..... 439/70, 439/73, 330, 331, 342
See application file for complete search history.

(56) References Cited

U.S. PATENT DOCUMENTS

| | | | | |
|---|---|---|---|---|
| 4,560,217 | A * | 12/1985 | Siano | 439/68 |
| 6,991,474 | B1 * | 1/2006 | Ju | 439/73 |
| 7,147,483 | B1 * | 12/2006 | Ju | 439/73 |
| 7,252,517 | B2 * | 8/2007 | Ju | 439/73 |
| 7,470,128 | B2 * | 12/2008 | Ju | 439/73 |

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

A clip comprises two pieces of load plates. Each load plate has a pressing portion extending downwardly in a middle position thereof and two retention portions at two ends thereof, the two pieces of load plates across dispose when the load plates are secured.

7 Claims, 3 Drawing Sheets

ELECTRICAL CONNECTOR ASSEMBLY AND CLIP MECHANISM THEREOF

BACKGROUND OF THE INVENTION

1. Field of the Invention

The present invention relates to an electrical connector assembly, and more particularly to an electrical connector assembly with a clip for securing an electronic package mounted within the socket assembly.

2. Description of the Prior Art

Electrical connectors typically used for electrically connecting an electronic package and a printed circuit board generally comprise an insulative housing, a plurality of contacts received in the insulative housing and a fasten device. The fasten device comprises a stiffener, a load plate pivotally mounted to one end of the stiffener and a lever pivotally mounted to the other end of the stiffener. The load plate is adapted to press the electronic package toward the insulative housing and the lever is used to lock the load plate to the stiffener. However, the lever and the load plate operation need big room, so this type electrical connector can be applied to a desktop and impossible to apply to a notebook.

Notebook usually uses the other load plate to fasten the electronic package to the insulative housing as referring to FIG. 1. FIG. 1 shown a load plate 2 is substantially rectangular configuration and has two parallel plate-form springs 21 to fasten and press the electronic package mounted to the insulative housing. Because an elasticity coefficient of the parallel plate-form springs 21 is great, so they will easy deformation. Accordingly, if the load plate 2 bears bigger force, they will deformation bigger, hence, we must limit the force that exert to the load plate 2 to avoid the load plate 2 deformation.

Therefore, there is need to supply an improved electrical connector assembly with a clip mechanism.

SUMMARY OF THE INVENTION

Accordingly, an object of the present invention is to provide an electrical connector assembly with a clip which can exert a downward force to the electronic package and not easy deformation.

In order to achieve the object set forth, a clip adapted to physically in contact with an electronic package disposed on a electrical connector comprises two pieces of load plates. Each load plate has a pressing portion extending downwardly in a middle position thereof and two retention portions at two ends thereof, the two pieces of load plates across dispose when the load plates are secured.

In order to further achieve the object set forth, an electrical connector assembly for securing an electronic package, comprising an electrical connector with an insulative housing for receiving the electronic package and a clip. The clip comprises two folded load plates and disposes upon the electrical connector for generating a downward force.

DESCRIPTION OF PREFERRED EMBODIMENT

Reference will now be made to the drawings to describe the present invention in detail.

Figure 1:
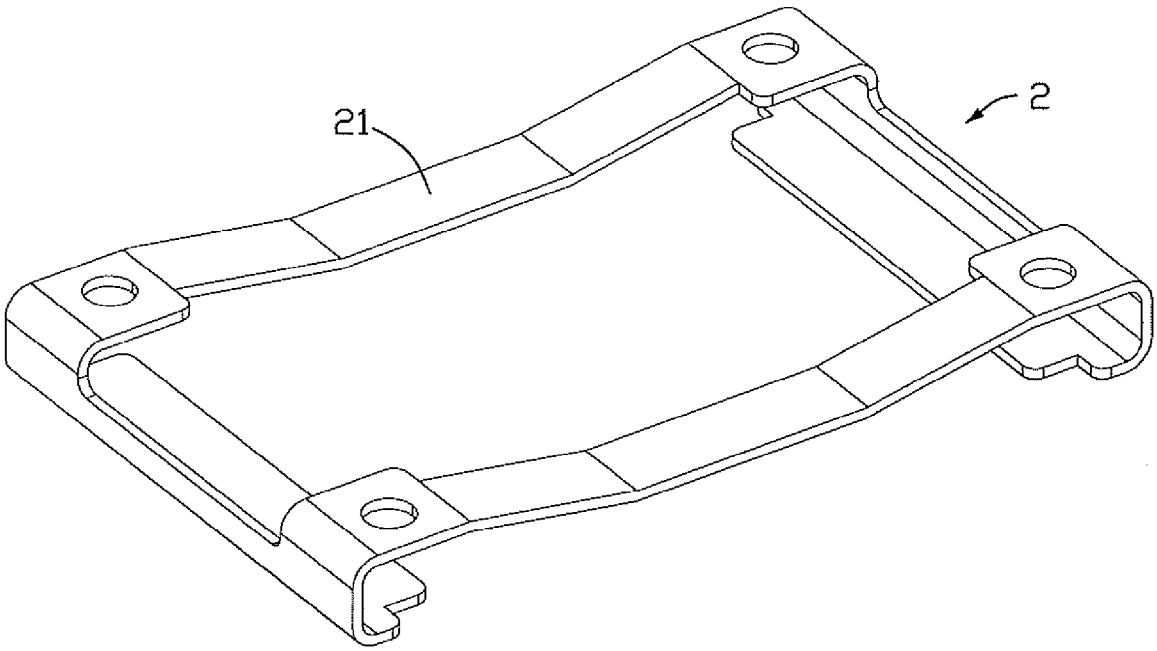
FIG. 1 (PRIOR ART)
FIG. 1 is a perspective view of a conventional electrical connector assembly.
Figure 2:
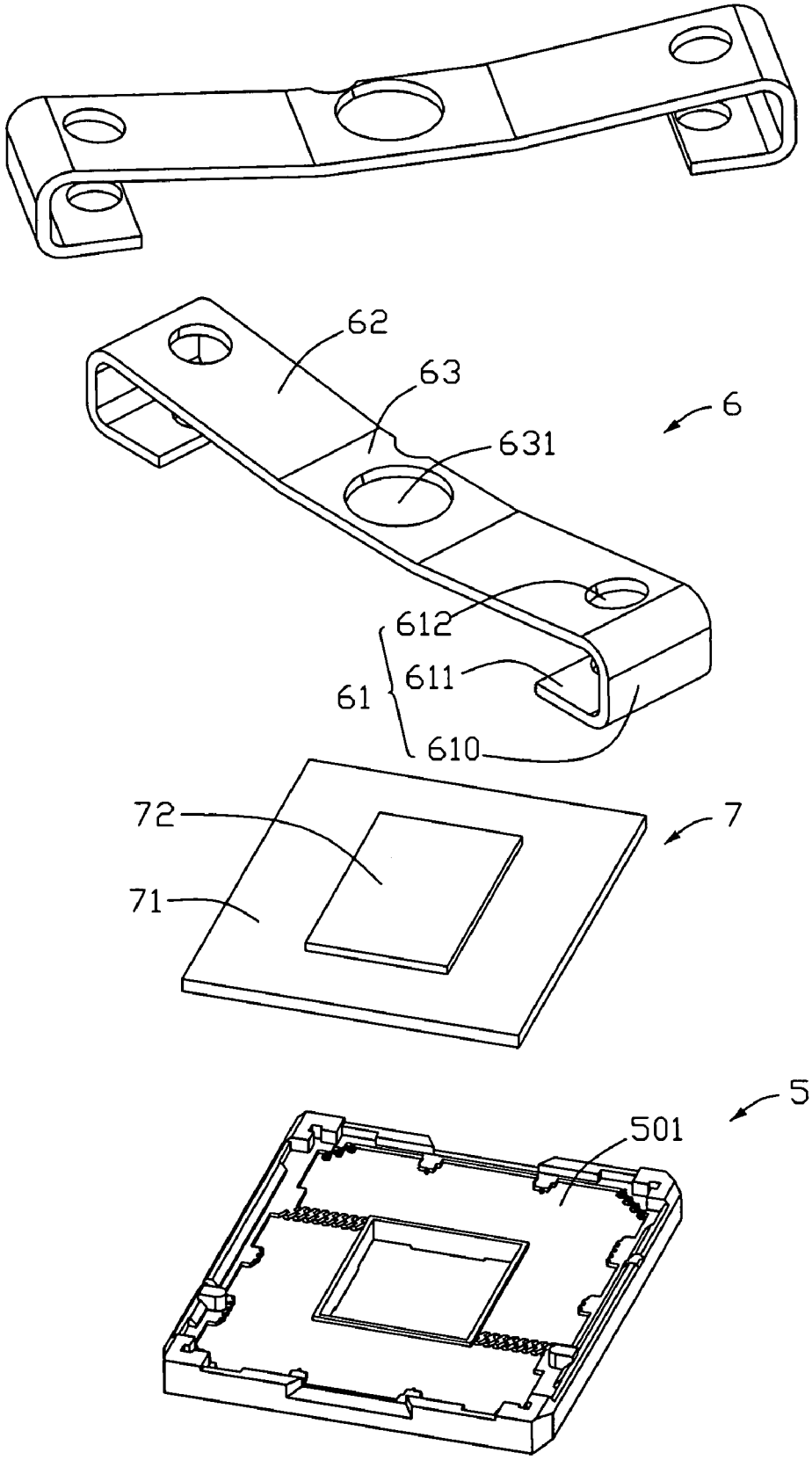
FIG. 2 is an exploded view of an electrical connector assembly in accordance with the present invention.
Figure 3:
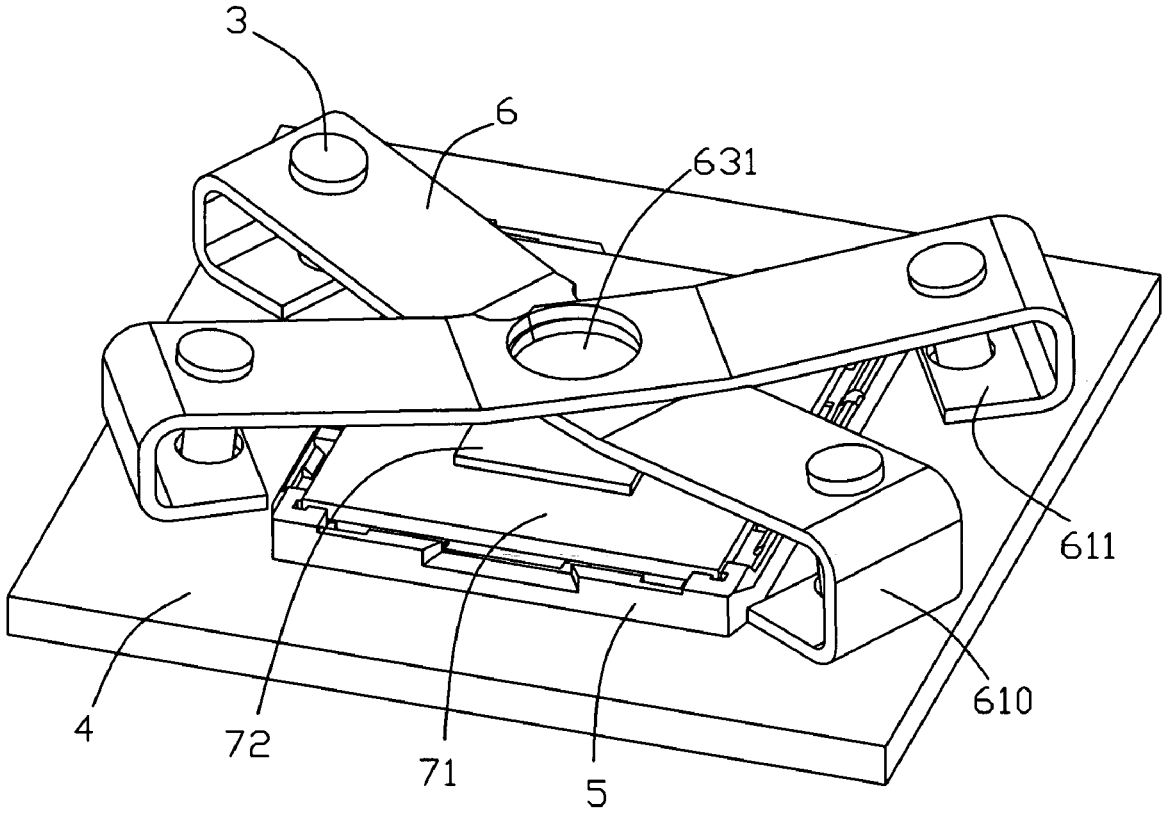
FIG. 3 is an assembled view of the electrical connector assembly shown in FIG. 2.

Referring to FIG. 2 and FIG. 3, an electrical connector assembly of the present invention used to connect an electronic package 7 and a printed circuit board 4 comprises an insulative housing 5, a plurality of contacts (not labeled) received in the insulative housing 5 and a clip 6 adapted to exert a force to the electronic package 7. The electronic package 7 generally includes a substrate 71 with a die 72 in a middle portion thereof.

The insulative housing 5 is substantially rectangular and defines a cavity 501 in an upper surface thereof. A plurality of contacts disposes in the cavity 501 as in a matrix. The contacts contact with the electronic package 7 by being pressed in a top end thereof and are soldered to the printed circuit board 4 in a bottom end thereof.

The clip 6 has two independent load plates. Each load plate is substantially rectangular and comprises two retention portions 61 disposed at two ends thereof, a pressing portion 63 in a middle thereof and two oblique connecting portions 62 connecting the retention portions 61 and the pressing portion 63. The retention portion 61 bends downwardly firstly and then bends inwardly and forms a transition portion 610 and a supporting portion 611 for contacting the printed circuit board 4. The retention portion 610 has a hole 612 passing therethrough adapted to secure the clip 6 to the printed circuit board 4. The pressing portion 63 is located in a horizontal plane and connects with a lower end of the connecting portion 62. The pressing portion 63 has an opening 631 in the middle thereof.

In assembly, first, put one load plate upon the electronic package 7 which had been mounted in the insulative housing 5, then put the other load plate crossed to the first load plate and align with the openings 631. Second, secure the two load plates to the printed circuit board 4 by screws 3. In that condition, the pressing portion 63 generates a loading force to the die 72 of the electronic package 7 and the opening 631 of the pressing portion 63 can dissipate heat for the electronic package 7.

The present invention use two load plates as a clip to fasten the electronic package 7 to the insulative housing 5 and dissipate heat for the electronic package 7. The two load plates fold/cross together have a small elasticity coefficient than the conventional load plate. Thus, the load plate generates a small deformation. Because the load plate has good deformation resistance, so the load plate can bearing bigger force generating by a heat sink or other device, and could not press the electronic package 7 excessively. The two load plate can be made of the same material or different materials. The different materials could change the elasticity coefficient of the load plates.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A clip adapted to physically in contact with an electronic package disposed on an electrical connector, comprising:

two pieces of load plates and each load plate having a pressing portion extending downwardly in a middle position thereof and two retention portions at two ends thereof the two pieces of load plates crosswise disposed when the load plates are secured;

wherein each load plate has an opening in the middle of the pressing portion; and wherein the clip is secured on a printed circuit board by a plurality of screws.

2. The clip as claimed in claim 1, wherein the clip is seated upon the electronic package, the pressing portions are disposed crosswise to each other.

3. An electrical connector assembly for electrically connecting an electronic package to a printed circuit board, comprising:

an electrical connector with an insulative housing for receiving the electronic package;

a clip comprising two load plates folded together and disposed upon the electrical connector for generating a downward force; and mounted to the printed circuit board by screws;

wherein each load plate comprises two retention portions at two ends thereof, a pressing portion disposed in a middle thereof and two oblique connecting portions connecting the retention portion and the pressing portion together;

wherein the two load plates cross at the pressing portion; and wherein the pressing portions of the two load plates have an opening in common and in a crossed area.

4. The electrical connector assembly as claimed in claim 3, wherein the retention portion bends downwardly firstly and then bends inwardly.

5. The electrical connector assembly as claimed in claim 3, wherein the retention portion is extending beyond the insulative housing.

6. An electrical connector assembly comprising:

a printed circuit board defining a connector mounting area surrounded by a plurality of though holes;

a connector mounted to said connector mounting area;

an electronic package mounted upon the connector and having a thermal die on a center region on an upper surface thereof; and a clip device positioned upon the electronic package and having a center area downwardly pressing against the die, said center area defining therein an opening in a vertical direction to upwardly expose said die; wherein said clip device defines at least two legs mounted to the corresponding through holes, respectively, so as to have said clip device experienced in a tensioned manner;

wherein said clip device defines generally an X like configuration, and said center area is formed on an intersection of said X like configuration; and wherein said clip includes two parts discrete from each other, and each of said parts includes said two legs mounted to the corresponding mounting holes, respectively.

7. The electrical connector assembly as claimed in claim 6, wherein one part is essentially seated upon the other.

* * * * *